US005539261A

United States Patent [19]

Roth

[11] Patent Number: 5,539,261

[45] Date of Patent: Jul. 23, 1996

[54] MECHANICAL ALTERNATE ACTION TO ELECTRICAL PULSE CONVERTER

[75] Inventor: Roger R. Roth, Minnetonka, Minn.

[73] Assignee: Honeywell Inc., Minneapolis, Minn.

[21] Appl. No.: 425,311

[22] Filed: Apr. 17, 1995

Related U.S. Application Data

[63] Continuation of Ser. No. 6,111, Jan. 15, 1993.

[51] Int. Cl.[6] ..... H01H 47/22

[52] U.S. Cl. ..... 307/112; 361/160; 361/209; 307/115

[58] Field of Search ..... 323/225, 226, 323/232, 254, 349, 350, 271, 272, 282, 905; 315/287, DIG. 4, DIG. 7, 209, 227 R, 362; 307/115, 112, 157, 106; 331/129; 327/100; 361/160, 209

[56] References Cited

U.S. PATENT DOCUMENTS

| | | | |
|---|---|---|---|
| 3,401,265 | 9/1968 | Dotto | 323/905 |
| 3,461,354 | 8/1969 | Bollmeier | 361/209 |
| 3,517,259 | 6/1970 | Dotto | 323/905 |
| 3,525,925 | 8/1970 | Lord | 323/350 |
| 3,581,224 | 5/1971 | Nercessian | 323/271 |
| 4,170,747 | 10/1979 | Holmes | 315/DIG. 7 |
| 4,259,619 | 3/1981 | Wall | 307/115 |
| 4,321,652 | 3/1982 | Baker et al. | 361/209 |
| 4,338,649 | 7/1982 | Mosier | 361/139 |
| 4,385,280 | 5/1983 | Reisem | 335/230 |
| 4,408,250 | 10/1983 | Masuda | 361/160 |
| 4,414,521 | 11/1983 | Reisem | 335/281 |
| 4,414,602 | 11/1983 | Mosier | 361/190 |
| 4,433,356 | 2/1984 | Wyatt | 361/191 |
| 4,701,680 | 10/1987 | Alley et al. | 315/287 |
| 4,889,999 | 12/1989 | Rowen | 307/31 |
| 5,003,230 | 3/1991 | Wong et al. | 315/279 |
| 5,004,972 | 4/1991 | Roth | 323/320 |
| 5,028,862 | 7/1991 | Roth | 323/273 |
| 5,327,047 | 7/1994 | Gershen | 323/905 |

OTHER PUBLICATIONS

Honeywell Product Brochure Form No. 63–2293–2 (Rev. 2–92) for "EL7305 Electronic Ballast Controller".

Honeywell Product Brochure Form No. 63–2254–3 (Rev. 12–92) for "EL7315A Electronic Ballast Manual Dimmer".

Honeywell Product Brochure Form No. 63–2415 (Rev. 12–91) for "EL7316A1009 Electronic Ballast Manual Dimmer".

*Primary Examiner*—William M. Shoop, Jr.
*Assistant Examiner*—Peter Ganjoo
*Attorney, Agent, or Firm*—Charles L. Rubow

[57] ABSTRACT

A fluorescent light control circuit usable with a transformer relay for providing electric current pulses of alternating polarity in response to successive operations of a two position electromechanical switch, the circuit including first and second controllable current paths operable to conduct current in opposite directions only, the active path being operable to conduct current only momentarily following repositioning of the switch.

3 Claims, 2 Drawing Sheets

MECHANICAL ALTERNATE ACTION TO ELECTRICAL PULSE CONVERTER

This application is a continuation of application Ser. No. 08/006,111 filed Jan. 15, 1993.

BACKGROUND OF THE INVENTION

The present invention relates generally to apparatus for producing an electrical pulse in response to each actuation of a double throw electromechanical switch, and more particularly, to such apparatus for alternately producing pulses of electric current in opposite directions in response to successive opposing actuations of a double throw electromechanical switch, such pulses being suitable for controlling the state of a transformer relay.

The desirability of controlling the light output of fluorescent lighting fixtures for energy conservation and other reasons is well recognized. Partially for this purpose, fluorescent lighting fixtures are frequently provided with electronic dimming ballasts whose construction and operation are well known, and whose control requirements have become largely standardized. A relatively typical electronic ballast has four electrical input leads, of which two are alternating current (AC) power leads, and two are for connection to a device for providing dimming control signals. The color convention for the leads is white and black for the power leads and violet and gray for the control leads.

The electronic ballast is designed such that the energization which it supplies to fluorescent lamps connected thereto is effectively determined by the value of an impedance connected between the control leads. A short circuit between the control leads, resulting in a zero voltage therebetween, causes the lamps to be off. Impedances between the control leads which result in voltages between 1.5 and 9 volts cause the lamps to be on at an output level proportional to the voltage. Power to the ballast and lamps may be completely turned off by a separate switch or relay contacts in the black power lead.

A variety of devices are commercially available for effectively providing an impedance which is variable over the requisite range of values for controlling an electronic ballast. A circuit diagram for such a device is shown in the lower portion of FIG. 4. This diagram specifically represents the circuit used in Model EL7315 and Model EL7316 Electronic Ballast Manual Dimmers commercially available from Honeywell Inc.

As shown, the circuit includes a manually controlled variable resistor, and an ON-OFF switch formed by one section of a two pole, double throw switch. This circuit is operable, depending on the position of the manual controls, to provide an impedance which is at zero or variable between predetermined limits. In particular, if the ON-OFF switch is in the ON position, the impedance is determined by the variable impedance element. If the ON-OFF switch is in the OFF position, it provides a short circuit between violet and gray leads of the circuit. A switch separate from the Dimmer is required to completely shut off power to ballast and lamps.

Another device capable of controlling both the primary power to an electronic ballast and the dimming control signal required thereby is a remote relay control box, such as a Model EL7305 Electronic Ballast Controller, also commercially available from Honeywell Inc., and described in detail in U.S. Pat. Nos. 5,004,972 and 5,028,862 issued to R. Roth on Apr. 2, 1991 and Jul. 2, 1991, respectively. The EL7305 Controller includes four output leads for connection to the four input leads of an electronic ballast for providing both primary power and dimming control thereto. The EL7305 Controller also includes a pair of input leads for connection to the EL7315 or EL7316 Dimmer, and responds to signals therefrom by cutting off power to the electronic ballast if the ON-OFF switch is in the OFF position. If the ON-OFF switch is in the ON position, the Dimmer presents a variable impedance between the violet and gray leads for varying the light output of the fluorescent lamps. Thus, a separate manually operated switch is not required for complete control.

EL7305 Controllers, additionally, are capable of being interconnected to provide lighting control for large areas, and of accepting other input signals, such as provided by occupancy sensors. Because of these expanded capabilities, the EL7305 Controller is relatively expensive.

Another well known device for controlling power to a load, such as a fluorescent lighting fixture, from a remote momentary switch is a transformer relay. This device combines a transformer and relay into a single structure, thus reducing manufacturing and installation costs. Specifically, a transformer relay is a magnetic latching relay which can be operated remotely from a low voltage, momentary, wall mounted switch. One supplier of relatively typical transformer relays for lighting circuits is Enercon Data. These transformer relays have five electrical leads including white and black power leads, yellow and brown control leads, and a blue load lead for connection, in the case of a fluorescent lighting fixture, to the black primary power lead of the electronic ballast.

Such a prior art transformer relay is schematically illustrated in FIG. 1 along with a basic control circuit which includes a momentary single pole, double throw switch and a pair of steering diodes. Switching of the relay is accomplished by momentarily connecting a diode between the yellow and brown control leads. If the leads are connected through a diode with the cathode connected to the yellow lead, the relay supplies power to the load. If the leads are connected through a diode with the cathode connected to the brown lead, the relay switches OFF power to the load. Only a pulse is needed to change the state of the relay.

It is apparent from the preceding background discussion that a single wall unit capable of (1) providing direct input to a ballast dimmer to change the power level to a fluorescent lamp, or (2) providing the requisite inputs to a remote relay control box to achieve changes in power level and turn power ON or OFF, or (3) providing inputs to a ballast dimmer to vary the power level and to a transformer relay to turn power ON or OFF would be advantageous. Since a remote relay control box is considerably more expensive than a transformer relay, having the option to provide ON-OFF control from a single wall unit through a transformer relay in appropriate situations would also be advantageous.

SUMMARY OF THE INVENTION

The invention is a circuit for producing pulses of electric current in alternating directions, the circuit including first and second unidirectional paths capable of carrying current in opposite directions between a pair of terminals, the paths respectively including npn and pnp transistors having their collector/emitter electrodes connected in series with oppositely poled diodes, the bases of the transistors being connected to opposing fixed contacts of a double throw electrical switch, the movable contact of the switch being connected to one of the terminals through a capacitor. The switch may be a two position switch as required in certain conventional dimmer circuits, thereby facilitating physical combination of the circuits to provide a universal ON-OFF/dimming control wall unit for both transformer relay and remote relay control box systems.

A further object a feature of the invention, particularly as used in a transformer relay system, is that the state of the load is "remembered" in the event of a power failure, so that, upon return of power, preexisting conditions are automatically restored.

DESCRIPTION OF THE PREFERRED EMBODIMENT

Figure 1:
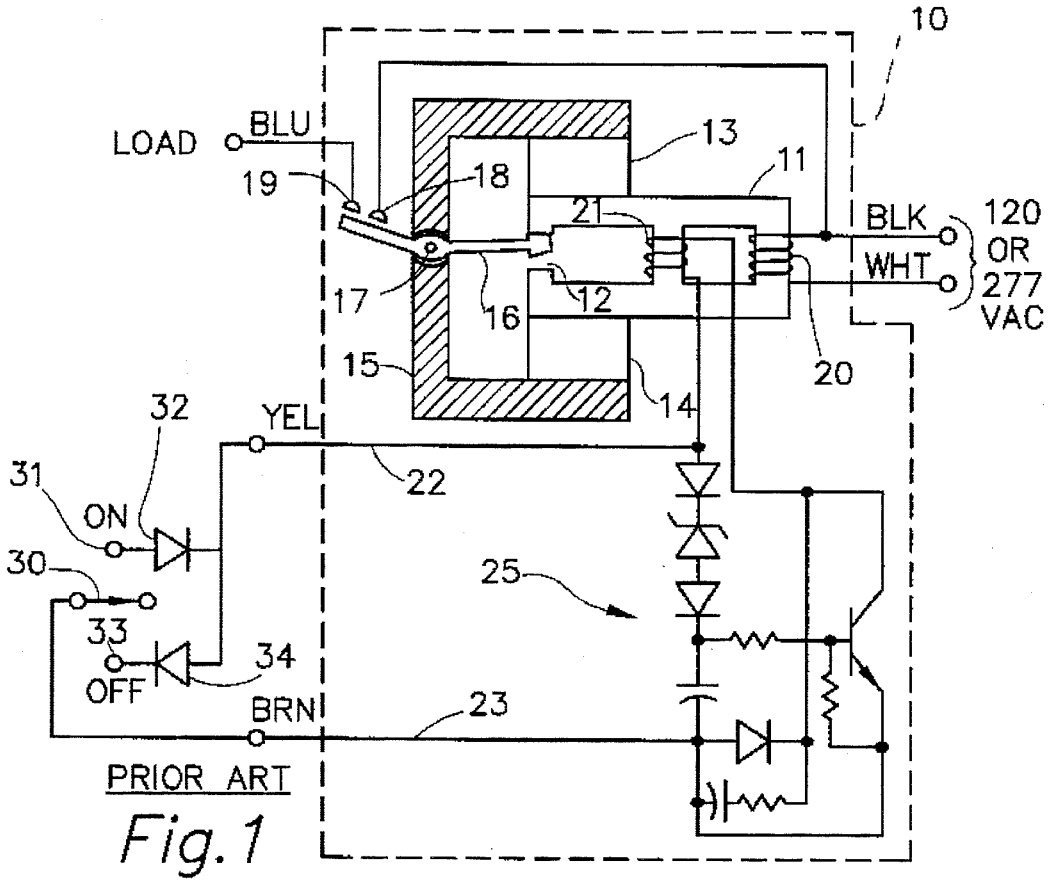
PRIOR ART Fig. 1
FIG. 1 is a schematic representation of a prior art transformer relay in combination with a simple control circuit including a pair of oppositely poled steering diodes.

In the schematic representation of FIG. 1, reference number 10 generally identifies a prior an transformer relay for use with which the present invention is particularly suitable. Such transformer relays are commercially available from Enercon Data under model numbers TR-120 and TR-277. The following brief description of a transformer relay is provided to facilitate understanding of the present invention.

Transformer relay 10 comprises a magnetic core 11 roughly in the shape of a figure eight with a gap 12 in one end of the configuration. A pair of permanent magnets 13 and 14 are positioned on the sides of the core near the end thereof containing gap 12. A U-shaped yoke 15 of magnetic material is positioned such that the terminal portions of the yoke are in contact with magnets, and the bight of the yoke extends around the end of the core containing gap 12.

An armature 16 of magnetic material is pivotably mounted to yoke 15 at a central pivot 17, the armature having a first arm terminating in gap 12 and movable between the surfaces of core 11 defining the gap. Armature 16 also includes a second arm which functions to electrically bridge a pair of fixed contacts 18 and 19 when the armature is at one of its rotational limits. Contacts 18 and 19 are respectively connected to a source of AC power, such as an electric utility, and to a load device, such as a fluorescent light fixture, whereby power to the fixture can be turned ON or OFF.

A primary winding 20 is provided on the end of core 11 opposite gap 12. Winding 20 is intended for energization from the AC power source. A secondary winding 21 is provided on the center cross piece of core 11. Secondary winding 21 is connected, either directly or through circuit components whose function will be described, to a pair of control leads 22 and 23. With the above-identified TR-120 or TR-277 transformer relay operating at its normal supply voltage, the open circuit voltage between leads 22 and 23 is a 60 Hz AC voltage of about 40 volts peak to peak. Net electric current through secondary winding 21 in one direction or the other can be employed to cause repositioning armature 16. About 500 milliamperes is required to cause transformer relay 10 to switch.

In particular, absent the influence of magnetic flux created by secondary winding 21, armature 16 will remain in its existing position with its first arm against one of the end surfaces bounding gap 12 in core 11. However, armature 16 can be attracted to its other stable position by changing the flux in the magnetic circuit comprising core 11 and yoke 15 by creating a net flux in one direction or the other through the cross member of core 11. This can be achieved by rectifying the voltage induced in secondary winding 21 by connecting a diode between leads 22 and 23.

The previously described magnetic circuit is designed to be actuated by a short pulse of electric current. Reference numeral 25 generally identifies circuitry for preventing problems, such as heat and possible contact chatter if leads 22 and 23 are shorted together. Also, circuitry 25 functions to open the circuit through relay contacts 18 and 19 in the event leads 22 and 23 are shorted.

Also illustrated in FIG. 1 is a simple arrangement for momentarily connecting a diode of one polarity or the other across leads 22 and 23 so as to position armature 16 as desired. In particular, reference numeral 30 identifies a double throw switch having a spring return to its center position. A first fixed contact 31 is connected to the anode of a diode 32, whose cathode is connected to lead 22. A second fixed contact 33 is connected to the cathode of a diode 34, whose anode is connected to lead 22. The pole of switch 30 is connected to lead 23. Thus, bringing the movable contact of switch 30 against fixed contacts 31 or 33 effectively connects diode 32 or diode 34 across leads 22 and 23, thereby creating a net current flow in one direction or the other through secondary winding 21, and creating a net flux in one direction or the other through core 11 so as to reposition armature 16.

Figure 2A:
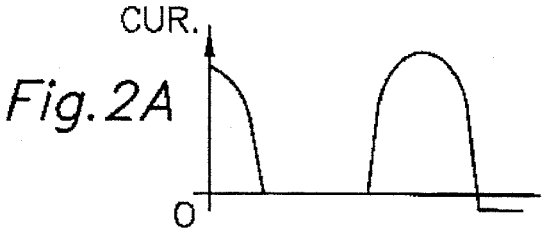
FIGS. 2A and 2B are representations of electrical signal waveforms which occur with the switch in the control circuit of FIG. 1 providing electrical continuity through one of the diodes in the circuit.
Figure 3A:
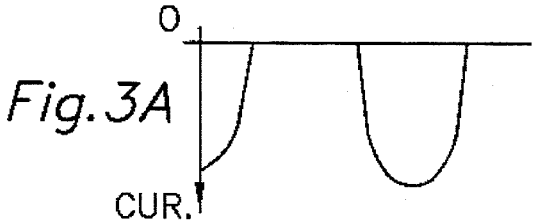
FIGS. 3A and 3B are representations of electrical signal waveforms which occur with the switch providing electrical continuity through the other diode in the control circuit of FIG. 1.
Figure 2B:
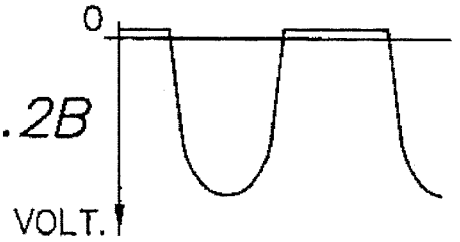
Figure 3B:
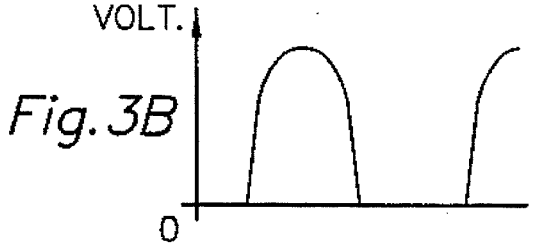

FIG. 2B illustrates the voltage waveform between leads 22 and 23 with the movable contact of switch 30 positioned against fixed contact 31. In this switch configuration, the AC voltage between leads 22 and 23 is rectified by diode 32, which results in current flow in one direction through secondary winding 21, as illustrated by the waveform of FIG. 2A, during the portion of the voltage cycle in which diode 32 is in a conducting state. Current flow in this direction switches transformer relay 10 to its "ON" state. Similarly, FIGS. 3B and 3A show the voltage between leads 22 and 23 and current through winding 21 with the movable contact of switch 30 positioned against fixed contact 33. In the arrangement of FIG. 1, the current pulses would continue successively as long as the movable contact of switch 30 is positioned against one of fixed contacts 31 and 33.

Figure 4:
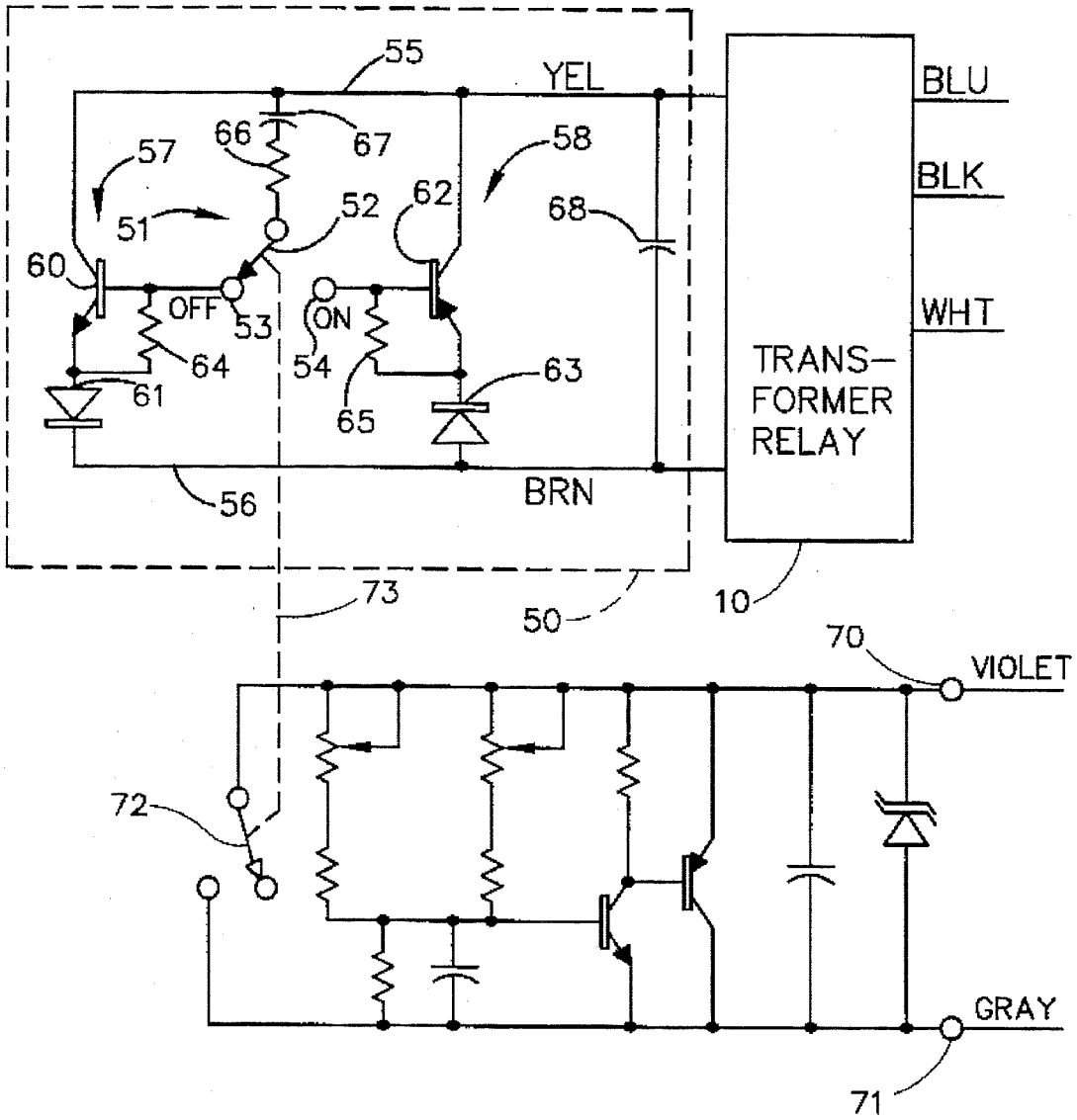
FIG. 4 is a circuit diagram of a universal control unit for providing ON-OFF and dimming control signals, the control unit incorporating a mechanical alternate action to electrical pulse generator circuit in accordance with the applicant's invention, the control unit shown connected to a transformer relay, such as the transformer relay of FIG. 1.

Turning to FIG. 4, reference number 10 again identifies a prior art transformer relay, such as the one shown in FIG. 1, in combination with a one shot circuit 50 in accordance with the applicant's invention and an electronic ballast dimming circuit. One shot circuit 50 provides alternating electric current pulses in opposite directions upon successive opposing actuations of a switch 51, the pulses being suitable for switching transformer relay 10 "ON" or "OFF". Switch 51 may be a first section of a double pole, double throw switch device as will be described hereinafter. One terminal of switch 51 is connected to a movable contact 52 which may be selectively positioned against either of fixed terminals or contacts 53 or 54.

Reference numerals 55 and 56 identify conductors connected to the yellow and brown control leads of transformer relay 10 (leads 22 and 23 in FIG. 1). Conductors 55 and 56 have connected therebetween two current paths generally identified by reference numerals 57 and 58. Each of the current paths includes a transistor having its collector connected to conductor 55 and its emitter connected through a diode to conductor 56. Specifically, current path 57 includes an npn transistor 60 whose emitter is connected to the anode of a diode 61, the cathode of which is connected to conductor 56. Current path 58 includes a pnp transistor 62 whose emitter is connected to the cathode of a diode 63, the anode of diode 63 being connected to conductor 56.

The base electrodes of transistors 60 and 62 are connected to switch contacts 53 and 54, respectively. The base electrode and emitter of each of transistors 60 and 62 are connected through a resistor, i.e., resistors 64 and 65, respectively.

Movable contact 52 of switch 51 is connected to conductor 55, which may be considered a reference conductor at a potential of zero volts, through a resistor 66 in series with a capacitor 67. A filter capacitor 68 is also connected between conductors 55 and 56.

With movable contact 52 of switch 51 positioned against fixed contact 53, which corresponds to the "OFF" state of transformer relay 10, capacitor 67 charges negatively with respect to conductor 55 by rectification of the AC voltage through diode 61 and the emitter-base junction of transistor 60. This causes transistor 60 to conduct current while the voltage on conductor 56 is negative with respect to that on conductor 55, thereby pulsing relay 10 to its "OFF" state.

Once capacitor 67 is fully charged, the current flowing through the base electrode of transistor 60 diminishes to zero since the leakage of capacitor 67 is low and resistor 64 can handle any leakage current without exceeding the base-emitter turn-on threshold voltage of the transistor. Thus, transistor 60 becomes non-conducting and transistor 62 remains non-conducting since there is no source of base current with switch 51 in its indicated state.

When movable contact 52 of switch 51 is repositioned against fixed contact 54, transistor 62 becomes conducting as a result of the current flowing from negatively charged capacitor 67 through the emitter-base junction of the transistor and diode 63 while the voltage on conductor 56 is positive with respect to that on conductor 55. The current flowing through transistor 62 from collector to emitter causes relay 10 to switch to its "ON" state. Capacitor 67 then become positively charged by rectification of the AC voltage through diode 63 and the emitter-base junction of transistor 62.

Once capacitor 67 is fully charged, the current flowing through the base electrode of transistor 62 becomes zero since the leakage of capacitor 67 is low and resistor 65 can handle any leakage current without exceeding the base-emitter turn-on threshold voltage of the transistor. Transistor 62 then becomes non-conducting and capacitor 67 is ready to cause transistor 60 to become conducting and pulse relay 10 to its "OFF" state when movable contact 52 of switch 51 is repositioned against fixed contact 53.

In operation of the circuit shown in FIG. 4, only a portion of the first current pulse represented by FIG. 2A or 3A would be permitted to occur, that portion being produced before transistor 60 or transistor 62 becomes non-conducting. Thus, only a pulse sufficient to switch transformer relay 10 to its "ON" or "OFF" state would be provided, thereby avoiding unnecessary control signals to the transformer relay.

The remainder of the circuit diagram of FIG. 4 represents the circuitry in a Model EL7315 Electronic Ballast Manual Dimmer. This circuit includes a pair of control leads 70 and 71 adapted for connection to the control leads of an electronic ballast, or to the control leads of a remote relay control box. A double throw switch 72 is included in the dimmer control circuit, switch 72 being formed by a second section of the double pole switch device forming switch 51, as indicated by the mechanical interconnection represented by dashed line 73. This feature facilitates incorporation of the present invention and the dimmer control circuit into a single universal wall mountable unit.

In accordance with the foregoing description, the applicant has provided a unique and simple circuit compatible with a variety of existing lighting control units for converting alternate action of an electromechanical switch to electric current pulses alternately in opposite directions suitable for controlling a transformer relay. This circuit may be simply combined with an existing dimmer control circuit to provide both dimming and ON/OFF control of fluorescent lighting from a single wall control unit through a relatively inexpensive transformer relay. Although a particular embodiment has been shown and described for illustrative purposes, a variety of modifications and other embodiments which do not depart from the applicant's contemplation and teaching will be apparent to those of ordinary skill in the relevant arts. It is intended that coverage not be limited to the embodiment shown, but only by the terms of the following claims.

The embodiments of the invention in which an exclusive property or right is claimed are defined as follows:

1. A circuit for producing pulses of electrical current in alternating directions in response to successive switch actuations, comprising:

first and second conductors adapted for connection to a source of alternating electric current;

a first unidirectional current path comprising an npn transistor having its emitter connected to the anode of a first diode, the collector of said npn transistor and the cathode of said diode being connected to said first and second conductors respectively;

a second unidirectional current path comprising a pnp transistor having its emitter connected to the cathode of a second diode, the collector of said pnp transistor and the anode of the second diode being connected to said first and second conductors respectively;

a manually operable switch having first, second and third terminals and a movable element for electrically connecting the third terminal alternately to said first and second terminals;

means electrically connecting the base electrode of said npn transistor to the first terminal of said switch;

means electrically connecting the base electrode of said pnp transistor to the second terminal of said switch; and means including a capacitor connecting the third terminal of said switch to said first conductor.

2. The circuit of claim 1 wherein said means connecting the third terminal of said switch to said first conductor includes a resistor in series with the capacitor.

3. The circuit of claim 2 wherein the third terminal of said manually operable switch comprises one pole of a two pole switch, the other pole of which forms part of a dimming circuit for providing an output voltage signal having either a zero value if said switch is in a first state or a voltage variable between first and second predetermined limits if said switch is in a second state, the value of the variable voltage being controlled by a potentiometer in the dimming control circuit.

* * * * *